US005567252A

United States Patent [19]

Mei et al.

[11] Patent Number: 5,567,252

[45] Date of Patent: Oct. 22, 1996

[54] NONTOXIC PRIMING MIX

[75] Inventors: George C. Mei, St. Louis, Mo.; James W. Pickett, Gillespie, Ill.

[73] Assignee: Olin Corporation, Cheshire, Conn.

[21] Appl. No.: 818,583

[22] Filed: Jan. 9, 1992

[51] Int. Cl.[6] ..... C06B 47/10; C06B 25/04; C06B 33/00

[52] U.S. Cl. ..... 149/22; 149/39; 149/105

[58] Field of Search ..... 149/22, 38, 39, 149/44, 88, 93, 105

[56] References Cited

U.S. PATENT DOCUMENTS

| | | | |
|---|---|---|---|
| 2,408,059 | 7/1940 | Garfield et al. | 260/141 |
| 2,410,801 | 11/1946 | Audrieth | 149/22 |
| 4,056,059 | 11/1977 | Zebree | 102/200 |
| 4,363,679 | 12/1982 | Hagel et al. | 149/37 |
| 4,484,960 | 11/1984 | Rucker | 149/22 |
| 4,556,921 | 1/1986 | Duguet | 149/22 |
| 4,581,082 | 4/1986 | Hagel et al. | 149/105 |
| 4,608,102 | 8/1986 | Krampen et al. | 149/92 |
| 4,675,059 | 6/1987 | Mei | 149/43 |
| 4,963,201 | 10/1990 | Bjerke et al. | 149/2 |
| 5,015,310 | 5/1991 | Sayles | 149/19.9 |
| 5,167,736 | 12/1992 | Mei et al. | 149/22 |

*Primary Examiner*—Charles T. Jordan
*Assistant Examiner*—John R. Hardee
*Attorney, Agent, or Firm*—John R. Wahl

[57] ABSTRACT

A nontoxic primer mix for use in a percussive primer, especially of the Boxer type which principally comprises diazodinitrophenol, iron oxide and boron. The composition may also contain a nitrate ester as a fuel, and tetrazene as a secondary explosive.

8 Claims, No Drawings

NONTOXIC PRIMING MIX

BACKGROUND OF THE INVENTION

1. Field of the Invention

This invention generally relates to primers and more particularly to a lead and barium free priming composition for use in ammunition.

2. Description of the Related Art

Various lead free priming mixtures for use in ammunition have been disclosed over the years. For example, my nontoxic, noncorrosive priming mix described in U.S. Pat. No. 4,675,059 is one such composition. This priming composition is specifically adapted to rim fire cartridges and contains diazodinitrophenol, also known as dinol or DDNP, manganese dioxide, tetrazene and glass.

Another example of a nontoxic priming mixture is U.S. Pat. No. 4,963,201, issued to Bjerke et al. This composition comprises dinol or potassium dinitrobenzofuroxane as the primary explosive, tetrazene as a secondary explosive, a nitrate ester fuel and strontium nitrate as the oxidizer.

Other examples are disclosed in U.S. Pat. Nos. 4,363679 and 4,581,082, issued to Hagel et al. In these patents, the initiating explosive may be strontium salts of mono- and dinitrodihydroxydiazobenzenes, and metal-free compounds such as diazodinitrophenol, tetrazene, or nitrogen tetrasulfide. Zinc peroxide is utilized as the sole or predominant oxidant. Zinc peroxide is a powerful oxidizer. However, it is an inefficient one. Only one oxygen atom per molecule is available for oxidation reactions. It is also difficult to get zinc peroxide in pure form. The result is reduced gas output and a cool flame with high slag content in the combustion product.

Another nontoxic primer mix is disclosed in U.S. Pat. No. 4,608,102 to Krampen. This mix has manganese dioxide as an oxidizer with dinol. The manganese dioxide, like zinc dioxide, is a powerful oxidizer but is inefficient and has the same drawbacks as the mix in Hagel et al.

These nontoxic mixes are less sensitive than the lead styphnate compositions. Therefore the metal parts configuration of the primer must be carefully optimized to ensure reliable ignition. This can only be done consistently in the Betdan primer system where the primer anvil is part of the cartridge and the primer factory installed under rigorously controlled conditions. Thus these nontoxic mixes are preferably used in Berdan type primers. Cartridges which use Bardan primers are not reloadable as the anvil is an integral part of the cartridge case. Also, the primer case is not readily removable and the primer cavity cannot adequately be cleaned after use.

Boxer type primers, on the other hand, contain the anvil within the primer cup and therefore require only a simple cavity in the casing head to receive the primer cup. The cavity is easily cleaned and the cup readily removed with a suitable punch. The Boxer type primer is thus used in reloadable ammunition and, understandably, is preferred by avid competition shooters.

Accordingly, there is still a need for a sensitive, clean burning, efficient priming mix that is nontoxic to humans and can be used in Boxer type primers that are widely used in reloadable cartridges today.

DESCRIPTION OF THE INVENTION

Surprisingly, it has been discovered that a priming composition of dinol and iron oxide can be used effectively in a boxer type primer. The mix preferably comprises dinol, boron and ferric oxide as an oxidizer. Other ingredients may be added to tailor the specific output of the primer. For example, PETN, calcium silicide or antimony sulfide, and a nitrate ester fuel, a single or double base propellant such as Ball Powder® propellant, may be added to optimize the nontoxic primer composition for use in Boxer type primers.

More specifically, the composition of the invention may contain diazodinitrophenol as the initiating explosive, tetrazene as a secondary explosive, boron as an abrasive agent and fuel, ferric oxide as the oxidizer, and a nitrate ester fuel such as PETN, nitrocellulose, or gun powder as a secondary fuel and a gas generator.

The core of the present invention is the combination of dinol, boron as a sensitizer, and iron oxide as the oxidizer. The boron sensitizes the mix in two respects. First, the boron is a very hard abrasive agent which is harder than antimony sulfide or calcium silicide. Second, it is a strong reducing agent, stronger than aluminum, antimony sulfide, or calcium silicide, the other reducing agents currently used. Its strong reducing potential permits the use of weaker but more efficient oxidizers such as calcium carbonate rather than strontium nitrate and dioxides or peroxides of zinc or manganese.

Surprisingly, iron oxide has been found to be an effective oxidizer in a nontoxic primer mix. The iron oxide is a weak oxidizer compared to nitrates, but it is stronger than the carbonates. The iron oxide oxidizer, when used in conjunction with dinol and boron, is also a good source of hot particles in a primer formulation. It is safe to handle, has low reactivity, and low toxicity and is therefore ideal for use in a non-toxic primer.

The mix of the invention is sensitive enough that the presence of tetrazene or PETN is not essential. The mix is sensitive enough in most applications without tetrazene and the sensitizing effect of the boron can be controlled to a 10 great extent by the choice of its particle size. The coarser the particle size is, the more sensitive the mix will be. For example, with a boron particle size of about 120 mesh, the mix is sensitive enough to be used in rimfire ammunition (which does not contain tetrazene) without the need for ground glass. In addition, the mix needs no other fuels such as aluminum, titanium, calcium silicide, or antimony sulfide (though these materials may be included for other considerations). Thus it is possible to formulate a mix with an output in terms of flame temperature, gas output, impulse, and hot particles, etc. comparable to the traditional lead styphnate based mixes.

The mix of the present invention can be used directly in Boxer type components without any modification. This is of particular importance because shooters can reload ammunition with this type of primer without having to buy primed cases. Finally, the mix of the invention forms nontoxic products including iron, ferrous oxide and boron oxides. The iron and ferrous oxide are clearly nontoxic. The boron oxides combine with water to form boric acid, which is commercially used as an antiseptic eye wash, and is therefore also clearly nontoxic.

The priming composition used for small arms primers must possess a certain range of sensitivity to mechanical shock or impact. This sensitivity is measured by dropping a predetermined weight a given height onto a firing pin on a test primer. Groups of 50 primers are usually tested to get a prediction of the sensitivity. The groups are tested at different drop heights in order to obtain a measure of the No Fire, 50% Fire, and All Fire levels for the primer. SAAMI (Small Arms and Ammunition Manufacturers Institute) requirements are no fire below a one inch height and all fire above 11 inches drop height for small pistol primers. This test is an industry production standard test. The mix according to the present invention falls well within this requirement as shown by the examples below.

EXAMPLE

A percussion-sensitive priming composition for use in boxer type primers was prepared which consisted of 45% by weight dinol having a partical size of about 20–30 microns, 27% ferric oxide (reagent grade having a grain size of 270 mesh), 10% boron powder (reagent grade having a particle size of 325 mesh), and 18% Ball Powder® propellant (WC350). Dry mixing was utilized in order to obtain a small quantity of a uniform, free flowing mixture. A wet mixing process would be utilized on a production scale. The dinol, prepared in accordance with the procedure in U.S. Pat. No. 2,408,059, incorporated herein by reference, was combined with the ferric oxide and Ball Powder® as dry powder and mixed. Finally, the boron was added and water was introduced to make a wet mix. The water content of the wet mix was about 22%.

This wet mix was then screened onto a multiperf plate to form pellets of the mixture. These pellets were then inserted into Winchester® #108 primers, dried and then assembled. Approximately 500 of the primers were prepared as above described. Primers were randomly selected and statistically tested in groups of 25 at various drop heights using the Probst statistical method. The statistically determined 99.99% all fire drop height was 9.86 inches (H+4s).

The same mix was also subjected to an impact test. This impact test involved placing about 1–2mg of the dried mix onto an anvil and dropping a 1.5 Kg weight about 10 cm onto the anvil and observing whether the mix sample detonated. Each of the compositions above readily detonated with no evidence of degradation of sensitivity.

The mix in accordance with the invention may consist of 20% to 50% dinol, 0 to 10% tetrazene, 2% to 30% boron, 5% to 40% iron oxide, and 0% to 20% auxiliary fuel such as PETN, gun powder, hexanitromannitol, or nitrocellulose, or other nitrate ester fuel, calcium silicide or antimony sulfide 0 to 20%, and aluminum 0% to 10%.

Boron, also used in the composition of the present invention may have an additional advantage. It produces boric oxide as its combustion product. Boric oxide combines rapidly with moisture, also produced in the combustion process, to make boric acid, as mentioned above. It is environmentally harmless and nontoxic. In addition, boric acid can act as a lubricant. Thus the composition of the invention may be a self lubricating primer composition which may tend to inhibit ammunition component and barrel wear.

It is to be understood that the above described embodiments of the invention are illustrative only. Modifications throughout may occur to those skilled in the art. Accordingly, it is intended that the invention is not to be limited to the embodiments disclosed herein but is defined by the scope and fair meaning of the appended claims. All patents, patent applications and other documents specifically referred to above are incorporated herein by reference in their entirety.

What is claimed is:

1. A nontoxic primer composition comprising diazodinitrophenol, iron oxide and boron.

2. The nontoxic primer composition of claim 1 further comprising a nitrate ester fuel.

3. The primer composition of claim 2 further comprising tetrazene as a secondary explosive.

4. The primer composition according to claim 1 wherein said diazodinitrophenol is in a range from about 20% to about said boron is in a range from about 2% to about 30%, and said iron oxide is in a range from about 5% to about 40%.

5. A primer composition comprising diazodinitrophenol, boron, tetrazene, and iron oxide as an oxidizer.

6. The primer composition according to claim 5 further comprising a nitrate ester fuel.

7. The priming composition according to claim 1 wherein the iron oxide is ferric oxide.

8. The primer composition according to claim 7 wherein said diazodinitrophenol is in a range from about 20% to about said boron is in a range from about 2% to about 30%, a nitrate ester fuel is in the range of about 0% to about 20%, and said ferric oxide is in a range from about 5% to about 40%.

* * * * *